US006887163B2

(12) United States Patent
Blankenship

(10) Patent No.: US 6,887,163 B2
(45) Date of Patent: May 3, 2005

(54) GOLF CLUB SHAFT ADAPTOR WITH SIDE WALL OPENINGS

(76) Inventor: William Blankenship, 2420 Highland Rd., Upland, CA (US) 91784

( * ) Notice: Subject to any disclaimer, the term of this patent is extended or adjusted under 35 U.S.C. 154(b) by 0 days.

(21) Appl. No.: 10/274,792

(22) Filed: Oct. 21, 2002

(65) Prior Publication Data

US 2004/0077433 A1 Apr. 22, 2004

(51) Int. Cl.[7] ..... A63B 53/02
(52) U.S. Cl. ..... 473/310
(58) Field of Search ..... 473/309, 310

(56) References Cited

U.S. PATENT DOCUMENTS

RE33,735 E * 11/1991 Rumble et al. ..... 473/323
5,797,806 A * 8/1998 Butler ..... 473/310
6,352,482 B1 * 3/2002 Jacobson et al. ..... 473/310
2003/0148822 A1 * 8/2003 Knuth ..... 473/345

* cited by examiner

*Primary Examiner*—Stephen Blau
(74) *Attorney, Agent, or Firm*—Denton L. Anderson; Sheldon & Mak

(57) ABSTRACT

A golf club shaft adaptor includes a cylindrical hollow body having side walls with at least one aperture therein. The cylindrical hollow body is sized and dimensioned to be retained within the hosel of a golf club head and to retain within the golf club adaptor the distal end of a golf club shaft. The golf club adaptor is adapted with respect to its configuration and material so that it will not do damage to a golf club shaft or to a golf club head during use of the golf club.

10 Claims, 2 Drawing Sheets

FIG. 1
FIG. 2
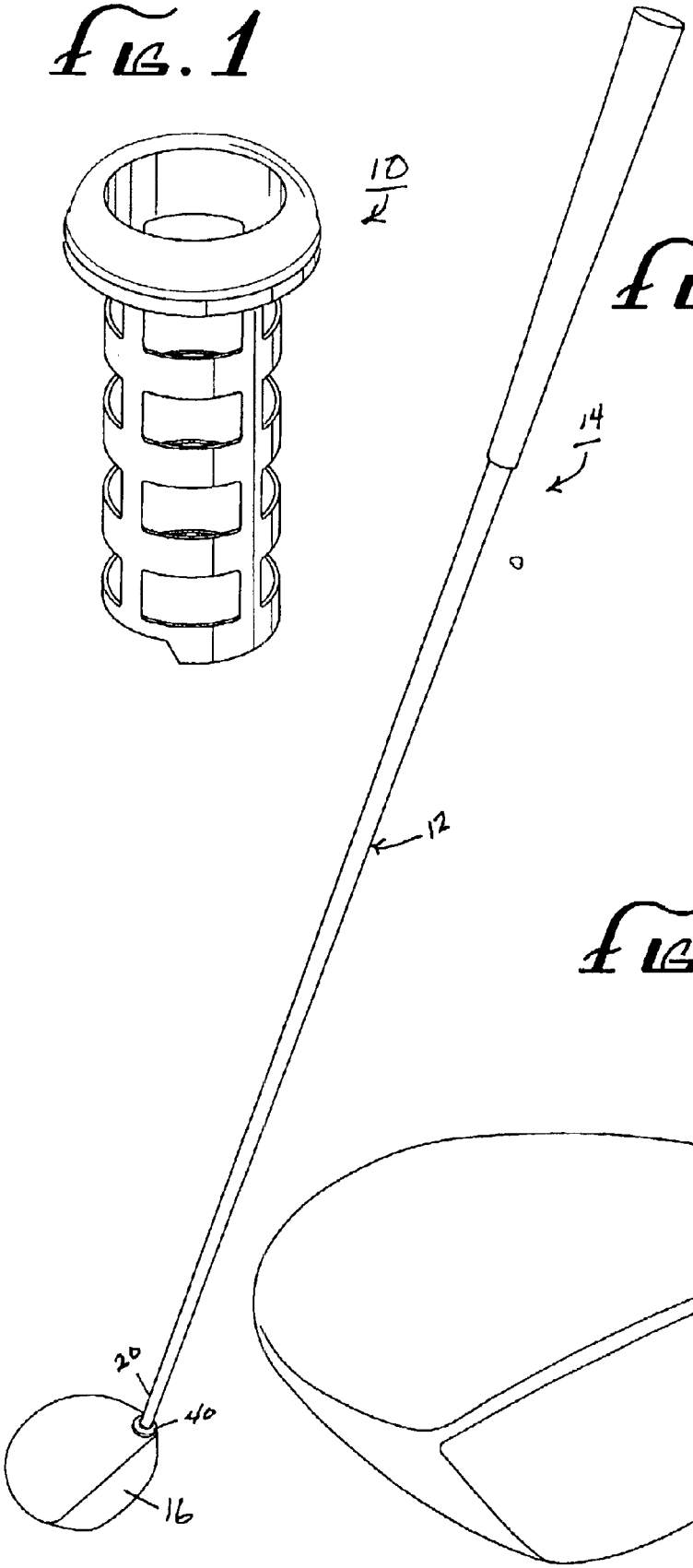
FIG. 3
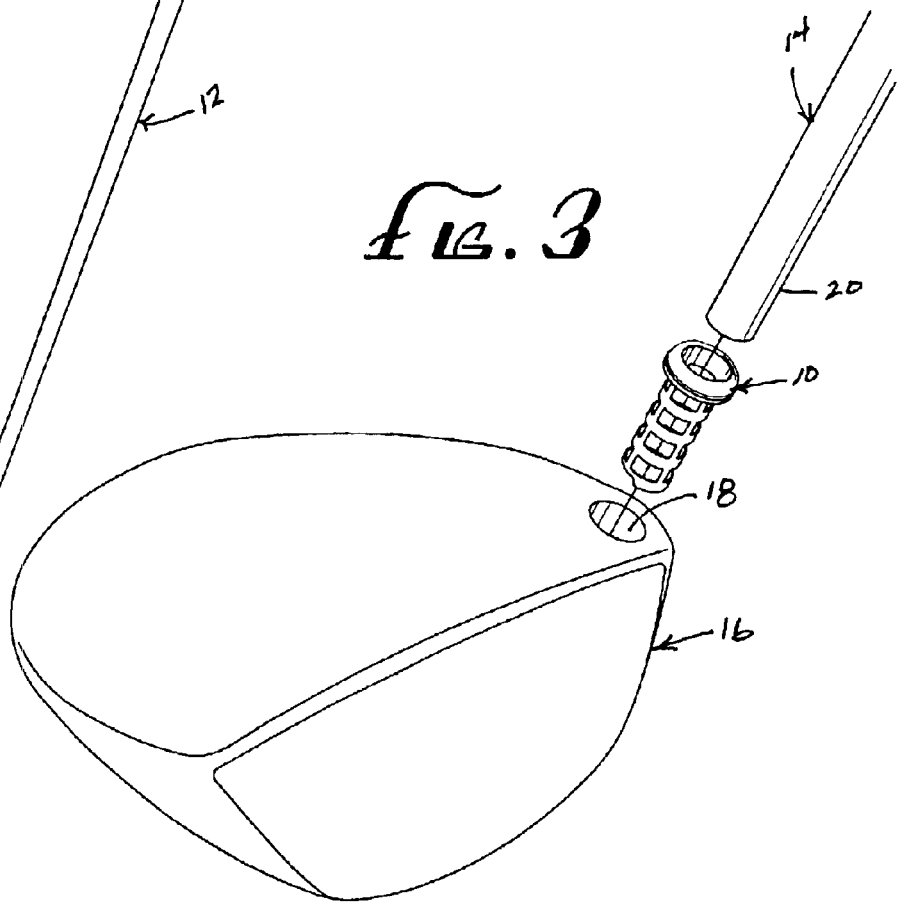

GOLF CLUB SHAFT ADAPTOR WITH SIDE WALL OPENINGS

FIELD OF THE INVENTION

This invention relates generally to golf clubs and, more specifically, to the retrofitting of shafts to different size golf club heads.

BACKGROUND OF THE INVENTION

A golf club wood typically comprises a head portion and a shaft portion. The shaft is affixed to the head by inserting the distal end of the shaft into a hole in the head. The hole in the head is commonly termed a "hosel."

It is not uncommon for a golfer, especially a skilled golfer, to retrofit the golfer's woods or irons with golf club shafts having a thinner diameter than the existing golf club shafts. To accomplish this, a skilled craftsman removes the distal end of each golf club shaft from the hosel in each golf head. The craftsman then reinserts a new shaft having a thinner diameter into each of the hosels. Because each new shaft has a lesser outer diameter than the inner diameter of its hosel, the craftsman generally has to interpose an adaptor, metal sleeve, shim or metal spring between the distal end of the shaft and the hosel. The craftsman then attempts to secure the shaft and adaptor within the hosel with a liquid adhesive.

Typically, the craftsman finds it difficult to rigidly secure the distal end of the shaft and the adaptor into the hosel. This is because the craftsman finds it difficult to thoroughly disperse the liquid adhesive to all surfaces of the shaft, adaptor and hosel. This is also true with respect to metal sleeves and shims. Metal coil springs having spacing between the coils of the spring have been tried as a golf club shaft adaptors. However, the sharpness of the coils and the hardness of the coils tends to cause the coil to cut into the golf club shaft during use of the golf club. This, in turn, leads to the premature failure of the golf club. Also, a spring will often collapse during the insertion of the shaft into the hosel, and this too may lead to the premature failure of the golf club.

Accordingly, there is a need for a solution to this problem in the prior art.

SUMMARY OF THE INVENTION

The invention satisfies this need. The invention is a golf club adaptor comprising a cylindrical hollow body having side walls, a first end, a second end, an outer diameter and an inner diameter. The side walls have an internal surface, and external surface and at least one aperture. The golf club adaptor is sized and dimensioned to facilitate the attachment of the distal end of a golf club shaft into the hosel of a golf club head, wherein the outer diameter of the golf club shaft is less than the diameter of the hosel.

DESCRIPTION OF THE DRAWINGS

These and other features, aspects and advantages of the present invention will become better understood with reference to the following description, appended claims and accompanying drawings where:

FIG. 1 is a perspective view of a golf club adaptor having features of the invention;

FIG. 2 is a perspective view of a golf club assembly having features of the invention;

FIG. 3 is an exploded perspective view of the golf club assembly illustrated in FIG. 2;

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 4:
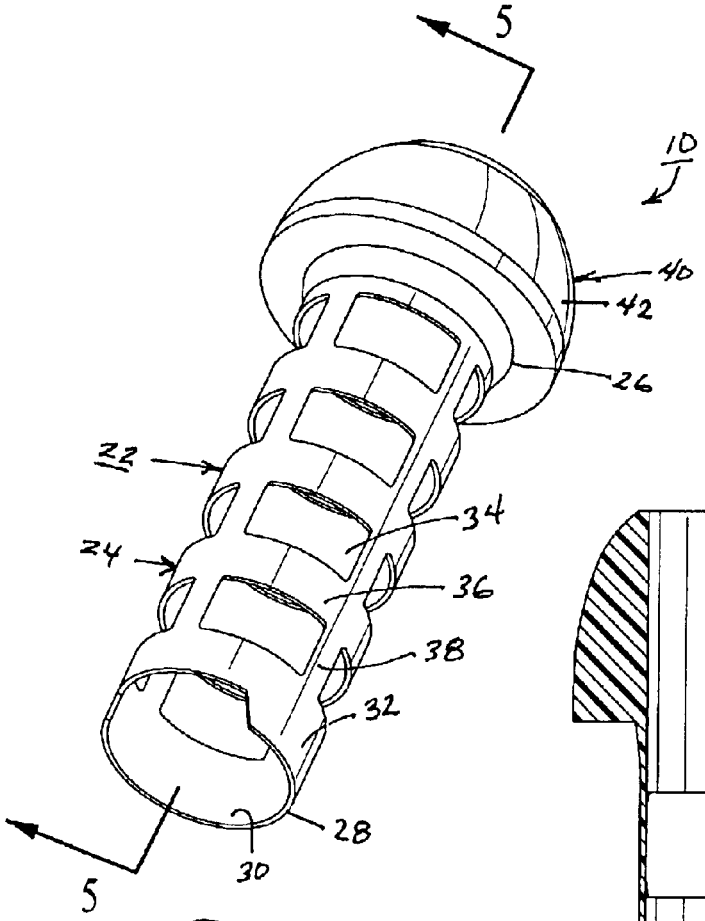
FIG. 4 is a second perspective view of the golf club adaptor illustrated in FIG. 1.
Figure 5:
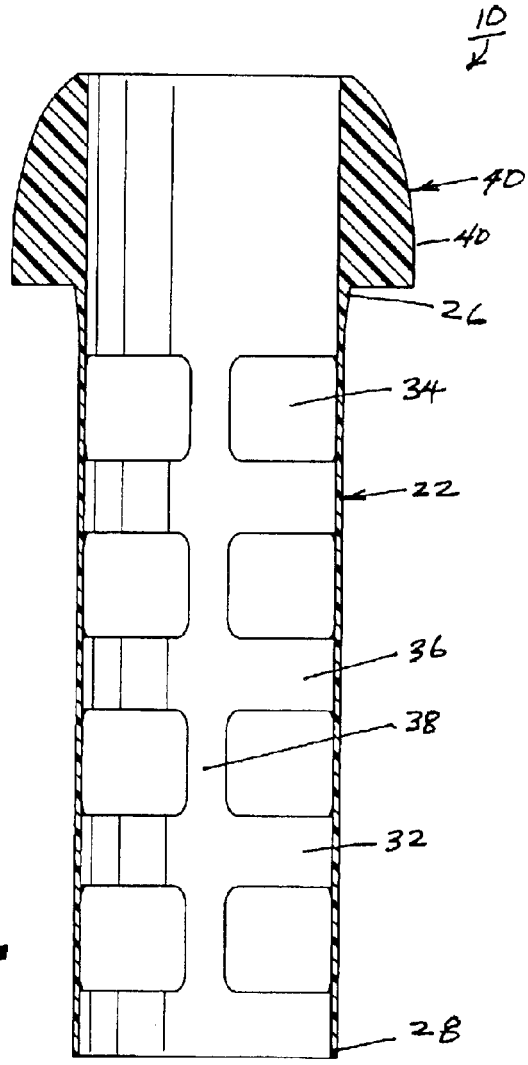
FIG. 5 is a cross-sectional view of the golf club adaptor taken along line 5—5.

The invention is a golf club shaft adaptor 10 as illustrated in FIGS. 1, 4 and 5. The shaft adaptor 10 can be used to conveniently attach the shaft 12 to a golf club 14 to a golf club head 16 having a hosel 18, wherein the distal end 20 of the golf club shaft 12 has a diameter which is less than the diameter of the hosel 18. The use of a shaft adaptor 10 to attach a golf club shaft 12 to a golf club head 16 is illustrated in FIGS. 2 and 3.

The shaft adaptor 10 comprises a cylindrical hollow body 22. The body 22 has side walls 24, a first end 26, a second end 28, an outer diameter and an inner diameter. The side walls 24 have an internal surface 30 and an external surface 32. The side walls 24 also have at least one aperture 34 to allow the communication of liquid adhesive between the external surface 32 of the side walls 24 and the internal surface 30 of the side walls 24.

The at least one aperture 34 can be irregular in shape or not. In the embodiment illustrated in the drawings, the side walls 24 have a plurality of rectangular shaped apertures 34. The apertures 34 are defined by side wall elements comprising a plurality of spatially spaced annular members 36 connected to one another by a plurality of longitudinal members 38. Each annular member 36 has a smooth interior surface and a smooth exterior surface. In the embodiment illustrated in the drawings, the annular members 36 are of a uniform thickness and each have an identical width. This is not necessary in the invention, however, so long as the annular members 36 are sufficiently smooth so as to not do damage to the hosel 18 of a golf club head 16 or to a golf club shaft 12 during the use of a golf club 14 employing the shaft adaptor 10. In the invention, the average width of each annular member 34 is typically at least about 5 times greater than the maximum thickness of the annular members 34.

The golf club adaptor 10 can further comprise a cylindrical hollow ferrule 40 disposed at the first end 26 of the shaft adaptor 10. The ferrule 40 has side walls 42, an inner diameter which is substantially the same as the inner diameter of the hollow body 22 and an outer diameter which is greater than the outer diameter of the hollow body 22. The ferrule 40 is typically used to cover the outer annulus of the hosel 18 after the shaft adaptor 10 and the golf club shaft 12 have been inserted into the hosel 18.

The entirety of the shaft adaptor 10 can be made as a single unit from a plastic material. One such plastic is ABS with low styrene, high flow characteristics and high impact characteristics so that the part can be handled without breaking. Other materials can also be used so long as the materials are sufficiently soft so as not to cut into the golf club head 16 or the golf club shaft 12 during use of a golf club 14 employing the shaft adaptor 10.

In a typical embodiment, the shaft adaptor 10 is used to attach the distal end 20 of a golf club shaft 12 having an outer diameter of about 0.335 inches into a hosel 18 having a diameter of about 0.35 inches. Thus, a typical shaft adaptor

10 has an overall length of 1.105 inches, an external diameter of 0.354 inches and an internal diameter of 0.338 inches. The shaft adaptor 10 has a ferrule 40 with a maximum outside diameter of about 0.540 inches. The shaft adaptor 10 is comprised of a plurality of annular members 36 having a width of between about 0.075 inches and about 0.100 inches and a plurality of longitudinal members 38 having a width of about 0.05 inches. The plurality of annular members 36 and the plurality of longitudinal members 38 define a plurality of rectangular shaped apertures 34 having a width of about 0.121 inches and a length of about 0.207 inches.

In another typical embodiment of the invention, the adaptor 10 is 1.308 inches in length, 0.400 inches in outer diameter and 0.335 inches in internal diameter. In yet another typical embodiment of the invention, the adaptor 10 is 0.330 inches in length, 0.436 inches in outer diameter and 0.335 inches in internal diameter.

The invention has been found to provide an inexpensive but effective adaptor for the attachment of a golf club shaft to a golf club head wherein the distal end of the golf club shaft has a diameter narrower than the diameter of the hosel. The shaft adaptor of the invention avoids prior art problems regarding the ineffective attachment of the golf club shaft, adaptor and golf club head into a cohesive whole because the apertures within the side walls of the shaft adaptor allow for the efficient flow of liquid adhesive throughout the internal surfaces and external surfaces of the side walls of the shaft adaptor. Because of the smooth construction of the shaft adaptor and/or the use of soft materials, such as plastics, the shaft adaptor does not tend to damage either the golf club shaft or the golf club head during use of the golf club, even when the golf club shaft is made from graphite fibers.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A golf club shaft adaptor comprising a cylindrical hollow body having side walls, a first end, a second end, an outer diameter and an inner diameter, the side walls having an internal surface, an external surface, and at least one aperture, the side walls comprising a plurality of spatially separated annular members, each annular member having a smooth interior surface, a smooth exterior surface, an average width, and a maximum thickness, the average width of each annular member being at least 5 times greater than the maximum thickness of the annular member.

2. The golf club shaft adaptor of claim 1 wherein the outer diameter of the adaptor is about 0.350 inches and the inner diameter of the adaptor is about 0.335 inches.

3. The golf club assembly of claim 1 wherein the shaft adaptor is made from a plastic material.

4. The golf club assembly of claim 1 wherein the spatially separated annular members define a plurality of apertures within the side walls of the shaft adaptor.

5. The golf club assembly of claim 1 wherein a cylindrical hollow ferrule is disposed at the first end of the shaft adaptor, the ferrule having side walls, an inner diameter which is substantially the same as the inner diameter of the hollow body and an outer diameter which is greater than the outer diameter of the hollow body.

6. A golf club assembly comprising:

(a) a golf club head having a cylindrical hollow hosel, the hosel having an open first end;

(b) a tubular golf club shaft having a handle end and a shaft tip end, the shaft tip end having a smaller outer diameter than the inner diameter of the hosel;

(c) a shaft adapter having a cylindrical hollow body including side walls, a first end, a second end, an outer diameter which is smaller than the diameter of the hosel and an inner diameter which is greater than the outer diameter of the shaft tip end, the side walls having an internal surface, an external surface, and at least one aperture, the side walls comprising a plurality of spatially separated annular members, each annular member having a smooth interior surface, a smooth exterior surface, an average width, and a maximum thickness, the average width of each annular member being at least 5 times greater than the maximum thickness of the annular member;

wherein the shaft adapter is disposed within the hosel and wherein the shaft tip of the golf club shaft is disposed through the first end of the shaft adapter and into the shaft adapter.

7. The golf club assembly of claim 6 wherein the outer diameter of the golf club shaft is about 0.335 inches, the outer diameter of the adaptor is about 0.350 inches and the inner diameter of the adaptor is about 0.335 inches.

8. The golf club assembly of claim 6 wherein the shaft adaptor is made from a plastic material.

9. The golf club assembly of claim 6 wherein the spatially separated annular members define a plurality of apertures within the side walls of the shaft adaptor.

10. The golf club assembly of claim 6 wherein a cylindrical hollow ferrule is disposed at the first end of the shaft adaptor, the ferrule having side walls, an inner diameter which is substantially the same as the inner diameter of the hollow body and an outer body which is greater than the outer diameter of the hollow body.

* * * * *